US006087457A

United States Patent [19]

Tsai

[11] Patent Number: 6,087,457

[45] Date of Patent: Jul. 11, 2000

[54] SURFACE SIZING OF CELLULOSE BASED PRODUCTS

[75] Inventor: Yi-Guan Tsai, Roswell, Ga.

[73] Assignee: Eka Chemicals AB, Bohus, Sweden

[21] Appl. No.: 08/625,616

[22] Filed: Mar. 29, 1996

[51] Int. Cl.[7] ..... C08F 20/02; C08F 20/06; C08F 20/10; C08F 28/02

[52] U.S. Cl. ..... 526/72; 526/78; 526/79; 526/80; 526/87; 162/135; 162/168.1; 162/168.7

[58] Field of Search ..... 526/72, 78, 79, 526/80, 87; 162/135, 168.1, 168.7

[56] References Cited

U.S. PATENT DOCUMENTS

| | | | |
|---|---|---|---|
| 4,298,513 | 11/1981 | Distler et al. . | |
| 4,661,557 | 4/1987 | Bubam et al. | 524/770 |
| 4,714,727 | 12/1987 | Hume, III | 524/271 |
| 4,835,212 | 5/1989 | Degen et al. | 524/734 |
| 4,855,343 | 8/1989 | Degen et al. | 524/47 |
| 4,908,240 | 3/1990 | Auhorn et al. | 427/391 |
| 4,931,510 | 6/1990 | Sackmann et al. | 525/302 |
| 5,004,767 | 4/1991 | Krause et al. | 524/30 |
| 5,258,466 | 11/1993 | Sackmann et al. | 525/282 |
| 5,288,787 | 2/1994 | Sackmann et al. | 524/457 |
| 5,358,998 | 10/1994 | Wendel et al. | 524/734 |
| 5,364,945 | 11/1994 | Cai et al. | 549/253 |
| 5,672,392 | 9/1997 | De Clercq et al. | 427/391 |

FOREIGN PATENT DOCUMENTS

| | | | |
|---|---|---|---|
| 0 266 850 | 5/1988 | European Pat. Off. . | |
| 0 744 417 | 11/1996 | European Pat. Off. | C08F 212/06 |
| WO 95/13194 | 5/1995 | WIPO . | |
| WO 9608522 | 3/1996 | WIPO . | |

OTHER PUBLICATIONS

International Search Report, Jul. 14, 1997.

*Primary Examiner*—Jeffrey C. Mullis
*Attorney, Agent, or Firm*—Ralph J. Mancini; Lainie E. Parker

[57] ABSTRACT

The invention relates to a method of surface sizing cellulose based products such as paper, board and paper board. The method comprises applying to the surface of said products an aqueous dispersion of a copolymer obtainable by free-radical emulsion polymerization of a monomers mixture comprising at least one monomer selected from the group consisting of styrene and derivatives thereof; at least one monomer selected from the group consisting of esters of ethylenically unsaturated carboxylic acids and alkanols; and at least one monomer selected from the group consisting of ethylenically unsaturated carboxylic and sulfonic acids and salt thereof; optionally in combination with other ethylenically unsaturated copolymerizable monomers.

20 Claims, No Drawings

SURFACE SIZING OF CELLULOSE BASED PRODUCTS

FIELD OF THE INVENTION

The present invention relates to surface sizing of cellulose based products and more particularly to a method of sizing in which an aqueous dispersion of emulsion polymerized monomers is applied to the surface of such products.

BACKGROUND OF THE INVENTION

It is known in the art to use polymer dispersions as sizing agents in the the production of cellulose based products such as paper, board and paper board. The sizing agents delay or prevent the absorption and spreading of aqueous solutions in the sized products. A wide variety polymer dispersions have been disclosed in the prior art including those prepared by emulsion polymerization of ethylenically unsaturated monomers in the presence of emulsifiers and/or protective colloids which impart stability to the dispersions so formed. The dispersions can be used for surface sizing which involves applying the dispersion to the surface of the product to be sized. Examples of monomers used for this purpose include styrene and alkyl (meth)acrylates. Such surface sizes are among the most efficient now in use and usually provide high sizing response.

Besides having the capability of producing cellulose based products with the desired degree of resistance to penetration by aqueous liquids, such as for example printing and writing inks, the polymer dispersion to be used for surface sizing should be beneficial also from an application point of view. The surface size is usually applied to the surface of the cellulose based product in the size press. In order to prevent static electricity being built up during the application or converting process, it is common to add electrolytes into the size press. However, it is known that even low levels of electrolytes may cause the polymer particles contained in aqueous size dispersions to agglomerate and form deposits, leading to application problems such as difficulty in dosing the size dispersion, deteriorated size performance and poorly sized paper. In order to achieve optimum results in surface sizing it is thus desired that the polymer dispersions have good stability in the presence of bases and electrolytes. It is furthermore beneficial to the application process that the polymer dispersion has a low tendency to foaming and advantageous viscosity and flowability profiles.

It is, accordingly, an object of the present invention to provide an improved method of surface sizing cellulose based products. Another object of the invention to provide an aqueous dispersion containing emulsion polymerized monomers which results in improved surface sizing. It is another object of the invention to provide an aqueous dispersion containing emulsion polymerized monomers which has beneficial application characteristics in surface sizing and, in particular, high performance in the presence of electrolytes and bases. Other objects of the invention will become apparent.

SUMMARY OF THE INVENTION

The present invention relates to a method of sizing cellulose based products by applying to the surface of said products an aqueous dispersion of a copolymer obtainable by free-radical emulsion polymerization of a monomers mixture comprising at least one monomer selected from the group consisting of styrene and derivatives thereof; at least one monomer selected from the group consisting of esters of ethylenically unsaturated carboxylic acids and alkanols; and at least one monomer selected from the group consisting of ethylenically unsaturated carboxylic and sulfonic acids and salts thereof; optionally in combination with other ethylenically unsaturated copolymerizable monomers.

DETAILED DESCRIPTION OF THE INVENTION

The present invention generally relates to a method of sizing cellulose based products. The invention further relates to an aqueous sizing dispersion comprising emulsion polymerized monomers and to a method of preparing the dispersion. More specifically, the method of the invention comprises applying to the surface of cellulose based products an aqueous dispersion of a copolymer obtainable by free-radical emulsion polymerization of a monomer mixture containing (a) from 70 to 99.5% by weight of
  (a1) at least one monomer selected from the group consisting of styrene and derivatives thereof; and
  (a2) at least one monomer selected from the group consisting of esters of ethylenically unsaturated carboxylic acids and alkanols;
(b) from 0.5 to 15% by weight of at least one monomer selected from the group consisting of ethylenically unsaturated carboxyl acids and salts thereof, ethylenically unsaturated sulfonic acids and salts thereof; and
(c) from 0 to 15% by weight of other ethylenically unsaturated copolymerizable monomers.

According to the present invention it has been found that paper and similar cellulose based products having a very high resistance to penetration by aqueous liquids can be provided by surface sizing such products with an aqueous dispersion of finely divided particles of a copolymer comprising in emulsion polymerized form a monomer mixture based on styrene, alkyl acrylates and carboxy and/or sulfo group containing monomers. The present invention renders possible production of cellulose based products with improved sizing results as compared to methods using conventional aqueous dispersions of copolymers based on styrene and alkyl acrylates. It was surprisingly found that improvements could be achieved by incorporating carboxy and/or sulfo group containing monomers into the copolymer. Accordingly, the present invention enables the use of a lower polymer dosage to give the same sizing effect, thereby leading to cost reduction and economic benefits. As used herein, the term "sizing" refers to the treatment of cellulose based products in order to achieve increased resistance to penetration by aqueous liquids or increased hydrophobicity.

The subject dispersion is highly effective in the presence of electrolytes and bases, and has a low tendency to foaming and advantageous viscosity and flowability profiles, thereby enabling the production of cellulose based products having high sizing response in a very advantageous manner. The improved performance observed when using the subject dispersion in the presence of electrolytes offers substantial application benefits and hereby the problems associated with agglomeration and deposition observed with prior art dispersions can be alleviated or eliminated. The dispersion according to the invention can be prepared using low levels of unexpensive and readily available emulsifiers or dispersing agents and yet the dispersion shows high stability and performance over a broad pH range and in the presence of electrolytes, whereby additional stabilizers and/or protective colloids essentially can be dispensed with, which of course offers further economic benefits.

The monomers of groups (a), (b) and (c), as defined herein, which are used in the preparation of the present dispersion, contain at least one ethylenically unsaturated bond making the monomers capable of polymerizing by a free-radical mechanism.

The monomers of group (a) comprise (a1) at least one monomer selected from the group consisting of styrene and derivatives thereof. Styrene is preferred. Suitable styrene derivatives encompassed by group (al) include $C_1$–$C_4$ alkyl substituted styrenes such as α-methylstyrene and vinyltoluenes, but other types of derivatives can also be used, e.g. halogen substituted styrenes such as chlorostyrenes.

The monomers of group (a) further comprise (a2) at least one monomer selected from the group consisting of esters of ethylenically unsaturated carboxylic acids and alkanols. Monoethylenically unsaturated esters are preferred. The esters are suitably derived from carboxylic acids containing from 3 to 6, preferably from 3 to 4, carbon atoms, and alkanols containing from 1 to 18, suitably from 1 to 8 and preferably from 1 to 4, carbon atoms. The alkanols are preferably monohydric saturated alcohols. Suitable esters include fully esterified carboxylic acids, e.g. monoesters of monocarboxylic acids, such as alkyl acrylates and alkyl methacrylates, diesters of dicarboxylic acids, such as dialkyl maleates, dialkyl fumarates, and trialkyl esters of tricarboxylic acids, such as trialkylesters of aconitic acid. Among these, the alkyl acrylates and alkyl methacrylates are preferred.

Suitable alkyl acrylates and alkyl methacrylates include those of $C_1$–$C_{18}$, suitably $C_1$–$C_8$ and preferably $C_1$–$C_4$ alkyls. Examples of suitable alkyl acrylates include methyl, ethyl, n-propyl, n-butyl, iso-butyl, tert-butyl, neopentyl, n-hexyl, cyclohexyl, 2-ethylhexyl, octyl, decyl, palmityl and stearyl acrylates. Butyl acrylates and mixtures including butyl acrylates are particularly preferred. Examples of suitable alkyl methacrylates include methyl, isopropyl, n-butyl, iso-butyl and tert-butyl methacrylates.

The monomers of group (a) can be used in an amount of from about 70 to 99.5% by weight, suitably at least about 80% by weight, preferably at least about 85% by weight and most preferably from about 90% to about 99% by weight, based on the weight of monomers used in the polymerization. The monomers of group (a) can be used in a weight ratio monomer (a1) to monomer (a2) of from about 10:1 to about 1:10 and suitably from about 7:1 to about 1:3. In a preferred embodiment of the invention, the monomer of group (a1) constitutes at least 50% by weight of the monomers of group (a), and a preferred weight ratio (a1) to (a2) is from about 5:1 to about 1:1, most preferably about 4:1 to 2:1.

The monomers of group (b) comprise ethylenically unsaturated carboxyl acids and salts thereof as well as ethylenically unsaturated sulfonic acids and salt thereof, monoethylenically unsaturated monomers being preferred. The group (b) monomers thus containing at least one carboxy group or sulfo group, either in the form of free acid or salt, i.e., carboxylic acids, carboxylates, sulfonic acids and sulfonates. Generally, it is preferred to use the monomer in the free acid form. Carboxylates and sulfonates can be prepared from the corresponding acids by treating the monomers with a solution of base such as sodium hydroxide, potassium hydroxide, ammonia or amines, resulting in monomers being completely or partially neutralized. Among these, ammonia is generally preferred.

Examples of suitable carboxylic acid monomers include $C_3$–$C_6$, preferably $C_3$–$C_4$ carboxylic acids, e.g. monocarboxylic acids such as acrylic acid, methacrylic acid and half esters of di- and tricarboxylic acids, e.g. $C_1$–$C_4$ alkyl monoesters of maleic and fumaric acids, dicarboxylic acids, such as maleic acid, fumaric acid and itaconic acid, and tricarboxylic acids such as aconitic acid and its $C_1$–$C_4$ alkyl mono- and diesters. Examples of suitable sulfonic acid monomers include $C_2$–$C_{10}$ sulfonic acids, e.g. vinyl sulfonic acid (ethylene sulfonic acid), allyl sulfonic acid, styrene sulfonic acid, 2-sulfoethyl methacrylate, and 2-acrylamidopropane sulfonic acid. Generally, the carboxylic acids and carboxylates are preferred monomers of group (b) since, inter alia, they normally are more readily accessible and less expensive than the sulfonic acids.

The monomer of group (b) can be used in an amount of from about 0.5 to 15% by weight, suitably at least about 1% up to about 10%, preferably less than 7%, a preferred range being from about 1% to 5% by weight, based on the weight of monomers used in the polymerization.

In addition to the essential monomers of groups (a1), (a2) and (b), the subject dispersion may contain, in emulsion polymerized form, other ethylenically unsaturated copolymerizable monomers of group (c). Examples of suitable monomers comprised in group (c) include olefins, such as ethylene, propylene, 1-butene, isobutene, 1-hexene and 1-octene, aliphatic conjugated dienes, such as 1,3-butadiene and isoprene, vinyl carboxylates, such as vinyl acetate, vinyl propionate, vinyl butyrate, vinyl laurate and vinyl stearate, vinyl chloride, vinylidene chloride, (meth)acrylamides, such as acrylamide, methacrylamide, $C_1$–$C_{18}$ alkyl acrylamides and $C_1$–$C_{18}$ alkyl methacrylamides, and hydroxy functional monomers.

Preferred monomers comprised in group (c) are hydroxy functional monomers, i.e., monomers containing at least one hydroxy group. Examples of such monomers include N-alkanol amides and hydroxyalkylesters of monoethylenically unsaturated carboxylic acids in which the N-alkanol and hydroxyalkyl groups suitably contain from 1 to 18 carbon atoms, preferably $C_1$–$C_4$. Examples of suitable hydroxy functional monomers include hydroxyalkyl acrylates, such as 2-hydroxyethyl acrylate and 3-hydroxypropyl acrylate, hydroxyalkyl methacrylates, such as 2-hydroxyethyl methacrylate and 3-hydroxypropyl methacrylate, N-alkanol acrylamides, such as N-methylol acrylamide, and N-alkanol methacrylamides, such as N-methylol methacrylamide. Among these monomers, the hydroxyalkyl acrylates and methacrylates are preferred.

The monomer of group (c) can be used in an amount of up to about 15% by weight, suitably from 0.5% to about 10%, preferably up to about 5%, and a preferred range is from 1% to about 5% by weight, based on the weight of monomers used in the polymerization, the sum of percentages of (a)+(b)+(c) being 100.

The dispersion according to the invention can be prepared by copolymerizing monomers of groups (a), (b) and (c) in conventional manner. Emulsion polymerization processes are known in the art and reference is made to Encyclopedia of Polymer Science and Engineering, Vol. 6, Emulsion Polymerization, pp. 1–51, John Wiley & Sons, Inc., 1986, which is hereby incorporated herein by reference. The polymerization is suitably initiated in an aqueous phase containing monomers, emulsifier and free-radical initiator, added in arbitrary order, in the absence of oxygen and in an inert gas atmosphere, for example under nitrogen. The emulsion polymerization suitably takes place under stirring at temperatures between 20° C. and 100° C., preferably between 60° C. to 90° C.

Suitable free-radical polymerization initiators are all those capable of initiating free-radical polymerizations, e.g.

conventional thermal initiators, such as potassium and ammonium persulfate, organic peroxides and hydroperoxides, and hydrogen peroxide, and redox systems, such as iron(II)/peroxide, iron (II) /persulfate, peroxide/metabisulfate and persulfate/metabisulfate. Chain-transfer agents, such as conventional alkyl mercaptans or alkan thiols, are suitably used in the polymerization process in known manner for modifying the molecular weight of the copolymers.

The polymerization can be carried out as a batch process or in the form of a feed process, or a combination thereof. Suitably, a part of the monomers to be used are initially polymerized, and the remainder of the monomers are subsequently fed to the polymerization zone, either continuously or in steps, optionally in conjunction with additional free-radical initiator.

The polymer dispersion is preferably obtained by the steps of (i) initial polymerization of at least one monomer of group (a), and (ii) subsequent polymerization of monomers of groups (a), (b) and (c).

In this preferred embodiment, the initial polymerization step (i) is carried out in the substantial absence of monomers of groups (b) and (c), and at least a part of the total weight of group (a) monomers to be used is present during the subsequent polymerization step (ii). The amount of group (a) monomers used in the subsequent polymerization step (ii) can be from 5% to 95% and suitably from 10% to 75% by weight, based on the total weight of group (a) monomers used in the overall polymerization process. This embodiment of the invention using a polymer dispersion prepared by means of the initial and subsequent polymerization steps may result in polymer particles with a pronounced core/shell structure, the core being more hydrophobic and the shell being less hydrophobic, i.e., more hydrophilic. The degree of core/shell structure obtained will depend on, inter alia, the types of monomers used and their weight ratios and the manner they and the initiator are introduced into the polymerization zone, as will be easily appreciated by the person skilled in the art. After completed polymerization, the resulting finely divided copolymer particles contained in the dispersion usually have a mean particle diameter less than about 400 nm. Suitably, the mean particle size is between about 40 and 200 nm and preferably within the range of from about 50 nm to 100 nm. The obtained copolymer suitable has a glass transition temperature, Tg, of from about 20° C. to about 80° C. and preferably from about 40° C. to about 70° C.

The polymer dispersion suitably contains at least one emulsifier or dispersing agent, the amount of which may be from 0.25 to 20%, preferably from 0.5 to 10% and most preferably from 0.75 to 5% by weight, based on the weight of monomers used in the polymerization. Anionic, cationic and nonionic emulsifiers can be used, and preference is given for anionic emulsifiers such as those commonly used for anionic dispersions or emulsions. Suitable anionic emulsifiers can be selected from alkyl and alkylaryl sulfates, sulfonates, ethersulfates, phosphates and etherphosphates, and dialkyl sulfosuccinates, suitably in the form of an alkali metal or ammonium salt, such as for example sodium laurylsulphate, sodium laurylsulphonate and sodium dodecylbenzenesulfonate. Polyacrylic acid and salts thereof can also be used. Nonionic emulsifiers can be selected from ethoxylated fatty alcohols, fatty acids, alkyl phenols or fatty acid amides, ethoxylated or non-ethoxylated glycerol esters, and sorbitan esters of fatty acids. The dispersions may also contain other additives such as preservative agents, optical brightening agents, anti-foaming agents, and protective colloids. Such additives should preferably be of nonionic or anionic character. Protective colloids that can be used include water-soluble cellulose derivatives, starch derivatives, gelatin, guar gum, xanthan gum, and polyvinyl alcohol.

The present dispersion have high stability both in the presence of bases and electrolytes and at extended storage, even when prepared from low levels of emulsifiers and also in the absence of protective colloids. Thus, according to a preferred embodiment of the invention, the polymer dispersion is prepared in the absence of protective colloids such as starches and derivatives thereof, which are commonly used in the polymerization process and, usually, in high levels.

The dispersion according to the invention can have a solids content of from 0.01 to 60%, suitably from 10 to 50% by weight, based on the aqueous dispersion. High solids content dispersions can of course be diluted with water or mixed aqueous solutions prior to use, and suitable copolymer solids contents for surface sizing is within the range of from about 0.01 to 1.0% by weight.

The method of sizing according to the invention comprises applying the aqueous polymer dispersion to the surface of cellulose based products such as paper, board and paper board. This is usually effected by means of a size press. It is of course also possible to apply the dispersion to cellulosic surfaces by means of spraying or immersion. The product treated with the polymer dispersion is normally dried at elevated temperatures. Suitably, the amount of dispersion applied to the surface is from 0.05 to 5%, preferably from 0.1 to 1% by weight, calculated as dry polymer on dry cellulose based product.

In surface sizing, electrolytes commonly added to the sizing composition present in the size press include salts of alkali metals such as sodium chloride and sodium sulphate.

Usually, the content of electrolyte is from 0.1% to 2% and suitably from about 0.3% to 1% by weight, based on the sizing composition. Thus, according to the present invention, the sizing composition used may be a mixture comprising an electrolyte and the aqueous polymer dispersion defined herein.

The invention is further illustrated in the following examples, which, however, are not intended to limit same. All parts and percentages are by weight unless otherwise indicated.

EXAMPLE 1

An aqueous dispersion according to the invention was prepared as follows:

In a stirred reactor equipped with a stirrer, a reflux condenser and addition means, 1 part of a sodium alkyl sulfonate and 50 parts of deionized water were initially introduced, the reactor contents heated to a temperature of 80° C., and 20% of a mixture (I) containing of 25 parts of styrene, 8 parts of n-butyl acrylate and 0.2 parts of n-dodecane thiol was subsequently introduced while purging the reactor with nitrogen gas. The copolymerization was initiated by addition of a solution of 0.1 parts of potassium persulfate in deionized water. After 15 minutes, the addition was commenced of the remainder of mixture (I) and a mixture (II) containing 0.2 parts of potassium persulfate in deionized water. The mixtures were continuously fed to the reactor, mixture (I) for 100 minutes and mixture (II) for 120 minutes. 45 minutes from commencing the addition of mixtures (I) and (II), the addition was commenced of a mixture (III) containing 0.9 parts of acrylic acid (2.9 wt. %, based on the weight of monomers used in the polymerization) and 0.9 parts of 2-hydroxyethyl acrylate in deionized water which was continuously added for 55 minutes. After completed monomers additions, the reactor contents were stirred for another 60 minutes at 80° C. and then cooled to room temperature and the dispersion was adjusted to pH 6.5 by addition of ammonium hydroxide. The dispersion of copolymer particles obtained, hereafter dispersion 1, had a solids content of about 37% and a mean particle diameter of about 65 nm, measured by using a Malvern Zetasizer 3.

EXAMPLE 2

Dispersions to be used according to the invention and for comparison purposes were prepared according to the procedure of Example 1 with the difference that the monomers of mixture (III) were replaced with the monomers and amounts thereof (wt. %; based on the total weight of monomers used in the polymerization) set forth in Table I.

TABLE I

| Dispersion | Monomers contained in Mixture (III) | | | |
|---|---|---|---|---|
| No. | Monomer (b) | (wt. %) | Monomer (c) | (wt. %) |
| 2 | AA | 2.5 | — | — |
| 3 | AA | 5.0 | — | — |
| 4 | IA | 2.5 | HEA | 2.5 |
| 5 | AA | 2.5 | HAM | 2.5 |
| 6 | MAA | 2.5 | HEA | 2.5 |
| 7 (Comp.) | — | — | HEA | 5.0 |
| 8 (Comp.) | — | — | — | — |

wherein
AA = acrylic acid
IA = itaconic acid
MMA = methacrylic acid
HEA = 2-hydroxyethyl acrylate
HAM = 2-hydroxyethyl acrylamide

EXAMPLE 3

Dispersion 1 of Example 1 was used for surface sizing of paper according to the method of the invention and the liquid penetration properties of the paper sheets obtained were tested. A comparison was made with an aqueous dispersion of a copolymer prepared by emulsion polymerization of styrene and n-butyl acrylate in the presence of starch as a protective colloid, hereafter dispersion 9.

Paper sheets with a basis weight of 80 g/m$^2$ were treated with dilute dispersion (solids content about 0.2% by weight), passed through a two roll size press and then dried on a drum drier at a temperature of 105° C.

The sizing response of the sheets was determined according to the Cobb method. Table II below shows the Cobb values measured according to TAPPI standard T 441 OS-63.

TABLE II

| Dispersion | Cobb (60) values (g/m$^2$) at dry polymer dosage | | | | | |
|---|---|---|---|---|---|---|
| used | 0.05% | 0.10% | 0.15% | 0.20% | 0.25% | 0.30% |
| 1 | >50 | 25 | 18 | 17 | — | — |
| 9 (Comp.) | >50 | >50 | 50 | 21 | 18 | — |

As is evident from Table II, paper sheets treated with dispersion 1 according to the invention showed considerably lower Cobb values and thus higher levels of sizing as compared to paper sheets treated with dispersion 9 used for comparison purposes at corresponding polymer dosages.

EXAMPLE 4

Dispersions 1 to 8 according to Example 2 were tested and their surface sizing efficiency was evaluated. Tests were also made with dispersions containing electrolytes which were prepared by adding aqueous sodium chloride to the dispersions followed by dilution with water. The sodium chloride content was 2% by weight, based on the dispersion.

The sheets were treated in accordance with Example 3 by applying 0.20% by weight of dry polymer on paper. The sizing response, or hydrophobicity, of the sheets was determined using the Hercules Size Test (HST) with test solution no. 2 (1% formic acid) at 80% reflectance. The results are set forth in Table III.

TABLE III

| Dispersion | HST value (sec.) at NaCl content | |
|---|---|---|
| used | 0 wt. % | 2 wt. % |
| 1 | 302 | 329 |
| 2 | 299 | 256 |
| 3 | 239 | n a |
| 4 | 297 | 135 |
| 5 | 291 | 273 |
| 6 | 317 | 277 |
| 7 (Comp.) | 308 | 49 |
| 8 (Comp.) | 301 | 29 |

wherein n a = not analyzed.

The table demonstrates that the dispersions according to the invention were not adversely affected by the presence of electrolyte. The comparative dispersions, however, essentially lost their sizing performance by the sodium chloride addition.

EXAMPLE 5

The efficiency of the dispersions at varying pH values was tested by preparing dispersions in accordance with Example 1 and then adding varying amounts of ammonium hydroxide. Paper was surface sized and evaluated as in Example 3. The results are shown in Table IV.

TABLE IV

| | pH of the dispersion | | | | | |
|---|---|---|---|---|---|---|
| | 4 | 5 | 6 | 7 | 8 | 9 |
| HST (seconds) | 320 | 330 | 310 | 320 | 350 | 260 |

The results show that the dispersion used according to the invention essentially in insensitive to changes of pH in the range from 4 to 9.

What is claimed is:

1. A method of surface sizing cellulose based products in order to increase resistance to penetration by aqueous liquids which comprises applying to the surface of said products a sizing composition which comprises an aqueous dispersion of a copolymer obtained by free-radical emulsion polymerization of a monomer mixture comprising (a) from 70 to 99% by weight of (a1) at least one monomer selected from the group consisting of styrene and derivatives thereof; and (a2) at least one monomer selected from the group consisting of esters of ethylenically unsaturated carboxylic acids and alkanols; wherein the monomer of (a1) comprises at least 50% by weight of (a); and (b) from 0.5 to 15% by weight of at least one monomer selected from the group consisting of ethylenically unsaturated carboxylic acids and salts thereof, and ethylenically unsaturated sulfonic acids and salts thereof; and (c) from 0.5 to 15% by weight of other ethylenically unsaturated copolymerizable monomers comprising at least one monomer containing a hydroxyl group, wherein the sum of the percentages of (a)+(b)+(c) is 100, wherein said polymerization is conducted in the absence of a protective colloid effective amount of starch.

2. The method according to claim 1, wherein the polymerization of said monomer mixture is carried out by the steps of (i) initial polymerization of at least one monomer of group (a); and (ii) subsequent polymerization of monomers of groups (a), (b) and (c).

3. The method according to claim 1, wherein the monomer of group (a1) is styrene.

4. The method according to claim 1, wherein the monomer of group (a2) is selected from $C_1$–$C_4$ alkyl acrylates, $C_1$–$C_4$ alkyl methacrylates, and mixtures thereof.

5. The method according to claim 4, wherein the monomer of group (a2) is butyl acrylate.

6. The method according to claim 1, wherein the monomers of group (a) are used in a weight ratio (a1) to (a2) of from 5:1 to 1:1.

7. The method according to claim 1, wherein the monomer of group (b) is a monoethylenically unsaturated mono- or dicarboxylic acid.

8. The method according to claim 7, wherein the mono- or dicarboxylic acid is selected from the group consisting of acrylic acid, methacrylic acid, maleic acid, fumaric acid, itaconic acid, aconitic acid and mixtures thereof.

9. The method according to claim 1, wherein the monomer mixture comprises from about 90 to about 99% by weight of monomers of group (a), from about 1 to about 5% by weight of monomer of group (b) and from about 1 to about 5% by weight of monomer of group (c).

10. The method of claim 1, wherein the cellulose based products are selected from the group consisting of paper and paper board.

11. A method of surface sizing cellulose-based products which comprises applying to the surface of said products by means of a size press a sizing composition comprising an aqueous dispersion of a copolymer obtained by free-radical emulsion polymerization of a monomer mixture containing (a) from 80 to 99% by weight of (a1) at least one monomer selected from the group consisting of styrene and derivatives thereof, and (a2) at least one monomer selected from the group consisting of esters of ethylenically unsaturated carboxylic acids and alkanols, where the monomer of group (a1) constitutes at least 50% by weight of the monomers of group (a); the weight ratio of (a1) to (a2) being from about 4:1 to 2:1;

(b) from 0.5 to 10% by weight of at least one monomer selected from the group consisting of ethylenically unsaturated carboxylic acids and salts thereof, and ethenically unsaturated sulfonic acids and salts thereof; and (c) from 0.5 to 10% by weight of other ethylenically unsaturated copolymerizable monomers comprising at least one monomer containing a hydroxyl group; the sum of percentages of (a)+(b)+(c) being 100.

12. The method of claim 11, wherein the monomer mixture contains from about 90 to 99% by weight of monomers of group (a) comprising (a1) styrene and (a2) a $C_1$–$C_4$ alkyl acrylate, $C_1$–$C_4$ alkyl methacrylate or mixtures thereof; from about 1 to about 5% by weight of a monomer of group (b) comprising acrylic acid, methacrylic acid, maleic acid, fumaric acid, itaconic acid, aconitic acid or mixtures thereof; and from 0.5 to about 5% by weight a of monomer of group (c).

13. The method of claim 12, wherein the monomer mixture contains from about 0.5 to 5% by weight of a monomer of group (c) comprising at least one monomer containing a hydroxyl group.

14. The method of claim 11, wherein polymerization of said monomer mixture is carried out by steps of (i) initial polymerization of at least one monomer of group (a); and (ii) subsequent polymerization of monomers of groups (a), (b) and (c).

15. A method of surface sizing cellulose-based products which comprises applying to the surface of said products a sizing composition comprising an aqueous dispersion of a copolymer obtained by free-radical emulsion polymerization of a monomer mixture containing (a) from 80 to 99% by weight of (a1) at least one monomer selected from the group consisting of styrene and derivatives thereof, and (a2) at least one monomer selected from the group consisting of esters of ethylenically unsaturated carboxylic acids and alkanols;

(b) from 0.5 to 10% by weight of at least one monomer selected from the group consisting of ethylenically unsaturated carboxylic acids and salts thereof; and ethylenically unsaturated sulfonic acids and salts thereof, and (c) from 0.5 to 10% by weight of other ethylenically unsaturated copolymerizable monomers comprising at least one monomer selected from the group consisting of hydroxyalkyl acrylates and hydroxalkyl methacrylates; the sum of percentages of (a)+(b)+(c) being 100.

16. The method of claim 15, wherein polymerization of said monomer mixture is carried out by the steps of (i) initial polymerization of at least one monomer of group (a); and (ii) subsequent polymerization of monomers of groups (a), (b) and (c).

17. The method of claim 15, wherein the monomer mixture contains (a1) styrene; (a2) butyl acrylate; and (b) a monomer selected from the group consisting of acrylic acid and methacrylic acid.

18. The method of claim 15, wherein the monomer mixture contains from about 1 to 5% by weight of a monomer of group (b).

19. The method of claim 15, wherein the monomer mixture contains from about 0.5 to 5% by weight of a monomer of group (c) compsiring at least one monomer containing a hydroxyl group.

20. The method of claim 18, wherein the monomer mixture contains from about 0.5 to 5% by weight of a monomer of group (c) comprising at least one monomer containing a hydroxyl group.

* * * * *

UNITED STATES PATENT AND TRADEMARK OFFICE

CERTIFICATE OF CORRECTION

PATENT NO. : 6,087,457
DATED : July 11, 2000
INVENTOR(S) : Yi-Guan Tsai

It is certified that error appears in the above-indentified patent and that said Letters Patent is hereby corrected as shown below:

Column 10, line 8, please change "a of " to --of a --.

Signed and Sealed this

Third Day of April, 2001

*Attest:*

NICHOLAS P. GODICI

*Attesting Officer*

*Acting Director of the United States Patent and Trademark Office*